US005314017A

United States Patent [19]

Schechter et al.

[11] Patent Number: 5,314,017

[45] Date of Patent: May 24, 1994

[54] METHOD OF ASSISTING THE RECOVERY OF PETROLEUM IN VERTICALLY FRACTURED FORMATIONS UTILIZING CARBON DIOXIDE GAS TO ESTABLISH GRAVITY DRAINAGE

[75] Inventors: David S. Schechter, E. Palo Alto; Dengen Zhou, Mountain View; Franklin M. Orr, Jr., Stanford, all of Calif.

[73] Assignee: Board of Trustees of the Leland Stanford Junior University, Stanford, Calif.

[21] Appl. No.: 957,043

[22] Filed: Oct. 5, 1992

[51] Int. Cl.[5] ..... E21B 43/16; E21B 47/00; E21B 47/10

[52] U.S. Cl. ..... 166/252; 166/250; 166/268; 166/305.1

[58] Field of Search ..... 166/252, 250, 263, 268, 166/305.1; 73/155

[56] References Cited

U.S. PATENT DOCUMENTS

| | | | |
|---|---|---|---|
| 4,733,725 | 3/1988 | Pittaway et al. | 166/252 |
| 4,742,873 | 5/1988 | Craig, III | 166/252 |
| 5,042,580 | 8/1991 | Cullick et al. | 166/252 |
| 5,111,882 | 5/1992 | Tang et al. | 166/252 |

OTHER PUBLICATIONS

*Scale-Up of Miscible Flood Process* Annual Report to DOE F. M. Orr Jr., Principal Investigator, Jan. 1991 (republished Jun. 1991).

SPE Paper No. 22947 *Analysis of a Tertiary $CO_2$ Flood Plot in a Naturally Fractured Reservoir* by D. Beliveau and D. A. Payne.

SPE Paper No. 22594 *Capillary Imbibition and Gravity Segregation in Low IFT Systems* by D. S. Schechter, D. Zhou and F. M. Orr, Jr.

*Miscible Flooding Industrial Affiliates Program, Project Review May* 7, 1992 Department of Petroleum Engineering; School of Earth Sciences; Stanford University.

*Miscible Flooding Industrial Affiliates Program, Project Review May* 15, 1991 Department of Petroleum Engineering; School of Earth Sciences; Stanford University.

*Miscible Flooding Industrial Affiliates Program, Project Review May* 15, 1990 Department of Petroleum Engineering; School of Earth Sciences; Stanford University.

*Primary Examiner*—George A. Suchfield

*Attorney, Agent, or Firm*—Townsend and Townsend Khourie and Crew

[57] ABSTRACT

The invention relates to assisting the recovery of petroleum from vertically fractured formations utilizing carbon dioxide gas to lower the interfacial tension between the gas and the petroleum in the vertical fractures and in the formation matrix adjacent the vertical fractures to cause vertical drainage of the petroleum down the fracture system. The invention also includes a method for identifying vertically fractured formations which may be particularly susceptible to such recovery with carbon dioxide gas using the capillary to gravity ratio ($1/N_B$) to select formations having a value for such ratio of 0.2 or less.

7 Claims, 10 Drawing Sheets

METHOD OF ASSISTING THE RECOVERY OF PETROLEUM IN VERTICALLY FRACTURED FORMATIONS UTILIZING CARBON DIOXIDE GAS TO ESTABLISH GRAVITY DRAINAGE

BACKGROUND OF THE INVENTION

The invention was made with government support under DOE Grant DE FG21-89MC26253 awarded by DOE. The Government has certain rights in the invention.

The invention relates to assisting the recovery of petroleum from vertically fractured formations utilizing carbon dioxide gas to lower the interfacial tension between the gas and the petroleum in the vertical fractures and in the formation matrix adjacent the vertical fractures to cause vertical drainage of the petroleum down the fracture system. The invention also includes a method for identifying vertically fractured formations which may be particularly susceptible to such recovery with carbon dioxide gas using the capillary to gravity ratio ($1/N_B$) to select formations having a value for such ratio of 0.2 or less.

The combined forces of viscous flow, gravity flow and capillary flow will determine the extent and efficiency of crossflow between zones of different permeability during a miscible or near-miscible flood in heterogeneous formations. Heretofore $CO_2$ has been used in a wide variety of assisted recovery projects. Generally, miscible flooding processes utilizing gas have been applied in reservoirs that are not too heterogeneous. The low viscosity of the injected gas insures that it will flow rapidly in high permeability zones or fractures. The worry is that highly heterogeneous or fractured reservoirs may experience early breakthrough of injected gas resulting in poor sweep efficiency, and requiring extensive cycling of injected fluid. Much of the current research is aimed at providing much better description of the heterogeneities present in various classes of reservoirs. That effort is based on the idea that heterogeneity dominates gas flow in most reservoirs.

$CO_2$ is an excellent solvent for crude oil if the pressure is near the minimum miscibility pressure (MMP). Slim tube results have confirmed that crude oil is efficiently displaced by $CO_2$ near the MMP. Unfortunately, experience in the field has often been disappointing due to early breakthrough of the injected $CO_2$ at production wells. Results of successful $CO_2$ floods have attributed to single, homogeneous layers resulting in a more or less stabilized front. Although viscous instabilities account for bypassing of some oil, spatial variability in permeability is the determining factor concerning arrival of the injected gas at the production wells. Due to the high mobility of $CO_2$ in comparison with oil in the reservoir, the injected gas flows rapidly through any high permeability channels in heterogeneous reservoirs leaving a significant portion of the oil saturated zone uncontacted. The extreme of this situation is fractured reservoirs in which very high permeability fractures coexist with low permeability matrix blocks of the formation. Thus, miscible gas injection into a fractured reservoir has been considered contrary to the reservoir engineer's "rule of thumb." That is, don't inject miscible gas such as $CO_2$ into a fractured reservoir because the injected gas will primarily flow through the high permeability fracture network and rapidly breakthrough to the production wells requiring a large amount of recycled gas to recover the cost. Many research efforts have focused on controlling the mobility of the injected $CO_2$. Alternative gas and water injection have been suggested as a means to slow flow in the highly permeable zones. Foam injection has also been suggested as a method of obtaining a better injection profile of the injected fluids. Most of the miscible or near miscible floods utilizing carbon dioxide have followed waterfloods in the formation of interest.

Imbibition has been long recognized as an important recovery mechanism during waterflooding of a fractured reservoir in which the matrix is water wet. The high capillary pressure associated with oil and water in porous media results in spontaneous imbibition of water into the oil saturated matrix. Heretofore, conventional wisdom has led researchers to believe that lowering the interfacial tension (IFT) would be unprofitable since by doing so both the gravity and capillary forces which provide the mechanism for fluid exchange would decrease, thereby reducing the recovery rates and ultimately the amount recovered.

Mattax and Kyte [Mattax, C.C. and Kyte, J.R., "Imbibition Oil Recovery from Fractured Water Drive Reservoirs", SPEJ (June 1972); 177–184; Trans. AIME, 125] and Kleppe and Morse [Kleppe, J., and Morse, R.A., "Oil Production from Fractured Reservoirs by Water Displacement," SPE paper 5084 presented at 1974 Annual Meeting of SPE, Houston, Tex., Oct. 6–9, 1974], for example, reported results of experiments performed with oil and water having a large value of IFT. They showed that the time dependence of recovery depends on the matrix geometry and physical properties of the fluids. Kleppe and Morse argued that for a given rock type ($k,\phi$), block size ($L^2$) and fluid properties ($\mu\omega,\mu o,\sigma$), the time scale for imbibition is given by $$t_d = t\sqrt{\frac{k}{\phi}}\left[\frac{\sigma}{\mu_\omega L^2}\right] \tag{1}$$

According to the scaling implied by Eq. (1), displacements in which values of $t_d$ are equal should show equivalent recovery. A key assumption for this scaling relation is that the flow is governed by capillary forces and gravity forces are negligible. According to Eq. (1), if the IFT ($\sigma$) is reduced, the time required to recover a given fraction of the oil increases. Hence, recovery rate decreases with IFT when capillary imbibition dominates the flow. This perception has been the reason that so few investigations have been attempted into lowering the IFT between the imbibing and displaced phase. Also, imbibition experiments have typically been performed on small core samples in which gravity was purposefully kept negligible. Such work was necessary in order to scale capillary dominated imbibition yet in the reservoir it is likely that a combination of forces will interact in determining the flow characteristics of a given situation and it is necessary to determine the regime so as to identify a model which is sufficiently simple yet accurate.

Experimental investigations of the effect of changes in IFT have been reported by Cuiec et al. [Cuiec, L.E., Bourbiaux, B. and Kalaydjian, F.; "Imbibition in Low-Permeability Porous Media: Understanding and Improvement of Oil Recovery," paper SPE 20259 presented at 1990 7th Annual Symposium on Enhanced Oil Recovery, Tulsa, OK, April] during imbibition in low permeability chalk samples. They found that lowering the IFT (by addition of alcohol) between the imbibing brine phase and the oil phase in the chalk sample reduced the rate of oil recovery, in accordance with the scaling theory of Eq. (1). However, their experiments were performed in very low permeability chalk with a length of a few centimeters. Calculations show their experiments were well into the capillary dominated region.

There have been many theoretical, numerical and experimental investigations of capillary donated imbibition in the past, designed primarily for scaling water injection in fractured reservoirs. Only a small portion of this literature concerns the transition to gravity dominated flow. In fact, most of the prior art completely disregards gravitational effects in lab experiments and reservoir simulations. Du Prey [Du Prey, L.: "Gravity and Capillary Effects during Imbibition", SPEJ, 3, 927-935, 1980] conducted the most extensive investigation into scaling the capillary and gravity forces during imbibition. The centrifuge was used to artificially increase the gravitational force. This method is typical of experimentalists investigating gravity effects for both drainage and imbibition due to the long times required to reach equilibrium in larger core samples.

The controlling dimensionless group used to correlate Du Prey's data was the capillary to gravity ratio (and in their specification $\pi_3$ = CGR which = $1/N_B$, the inverse Bond number) defined as $$\pi_3 = \frac{P_{cl}}{\Delta \rho g h} \tag{2}$$

where $P_{cl}$ is the displacement capillary pressure, and $\Delta\rho gh$ is the gravitational potential. If the mobility ratio and the shape factor remain constant and the value of $\pi_3$ is small (gravity effects significant to capillary forces), the recovery curves should superimpose or scale if the reference time is scaled in relation to gravity as $$t_g = h\phi\Delta S \frac{\mu_o}{\Delta \rho g \kappa_{omax}} \tag{3}$$

If imbibition is capillary dominated, the reference time may be defined as $$t_c = \frac{h^2 \phi S \mu_o}{\Delta \rho g \kappa_o \max} \tag{4}$$

Du Prey noted that large blocks will have a low value of $\pi_3$ but dismissed this method of reducing $\pi_3$ due to the experimental difficulty. $\pi_3$ may also be decreased by lowering the capillary pressure between the fluids or artificially increasing the acceleration due to gravity with the centrifuge. Du Prey chose the latter method because centrifugation "cannot lead to changes in wettability." Although this is a completely reasonable line of thinking for fundamental scaling issues, lowering the IFT was ignored in preference to the centrifuge thereby missing crucial features of the transition from capillary to gravity dominated imbibition. In summary, Du Prey's interpretation of the experiments on small samples, used to predict behavior of imbibition in large fractured blocks demonstrated that for small block sizes, capillarity is the dominant force and recovery time is proportional to the square of the block size and for large blocks, gravity becomes the dominant force and recovery becomes proportional the size of the block. He also indicates that for small samples of identical size subjected to centrifugation, theoretical predictions match recovery behavior. However, it was noticed that at high centrifugation speeds, experiment and theory no longer were in accordance. Du Prey speculated that the scaling disagreement at very low values of $\pi_3$, when the centrifuge speed was increased above 10 g, could be attributed to alteration of local flow laws.

Almost all drainage experiments in the prior art have been conducted in the forced manner. That is, the nonwetting phase needs to be injected at some pressure above the capillary threshold pressure in order to force the nonwetting phase into the porous medium. If the capillary threshold is lowered, as in the case with low IFT fluids, it is conceivable that the gravitational pressure in the fracture will be greater than entry pressure and "free-fall" drainage will occur. To achieve this, the core sample must be long and the IFT's low, thus requiring long equilibration times. As a consequence, this type of experiment is rare.

Jaquin et. al [Jaquin, C., Legait, B., Martin, J.M., Nectoux, A., Anterion, F., and Rioche, M., "Gravity Drainage in a Fissured Reservoir with Fluids Not in Equilibrium," 4th European Symposium on Enhanced Oil Recovery, Oct. 27-29, 1987, Hamburg, 769-78] investigated free fall drainage with gas/oil systems not in equilibrium and Nectoux [Nectoux, A., "Equilibrium Gas-Oil Drainage: Velocity, Gravitational and Compositional Effects," 4th European Symposium on Enhanced Oil Recovery, Oct. 27-29, 1987, Hamburg, 779-789] performed drainage experiments with crude oil. Pavone et al. [Pavone, D., Bruzzi, P. and Verre, R., "Gravity Drainage at Low IFT", 5th European Symposium on Enhanced Oil Recovery, Oct. 1989, Budapest, 165-174] recently conducted low IFT gravity drainage experiments in long core samples which indicated that flow occurred in two distinct regions. Initially, the oil phase rapidly drained when the saturation of the gas phase was still low. As the gas saturation increased, there was a sharp break in the drainage recovery curve in which 20% of the oil recovered continued to drain, but at a much slower rate. The rapid initial recovery was attributed to bulk flow as the larger pores emptied. The breakpoint and slow drainage occurring over a lengthy period was interpreted as film flow. During the course of their experiments, the IFT was kept constant between the gas and oil phases at 0.53 mN/m. The amount of connate water was varied to investigate the effect of water saturation on drainage efficiency. It was found that the slope of the recovery curve in the film flow region decreased as the amount of connate water increased demonstrating that increasing amounts of connate water slowed film drainage.

More prior art is found regarding gravity stabilized, forced gas injections in the presence of oil and connate water [Foulser, R.W.S., Naylor, P. and Seale, C., "Relative Permeabilities for the Gravity Stable Tertiary Displacement of Oil by Nitrogen", 10th International IEA Symposium on Enhanced Oil Recovery, Oct. 4-6, 1989, Stanford, Calif.]. Gravity drainage in this case may be highly efficient in the ultimate recovery of the oil phase. Residual oil saturations as low as 3% have been measured in the presence of connate water [Dumore, J.M. and Schols, R.S., "Drainage Capillary Pressure Functions and the Influence of Connate Water," SPEJ (Oct. 1974) 437-444]. Other experimental efforts have determined that film drainage after breakthrough during gas drive experiments may substantially contribute to the final oil recovery [Nectoux, A., "Equilibrium Gas-Oil Drainage: Velocity, Gravitational and Compositional Effects," 4th European Symposium on Enhanced Oil Recovery, Oct. 27-29, 1987, Hamburg, 779-789; Hagoort, J., "Oil Recovery by Gravity Drainage," SPEJ (June, 1980), 139-150].

Capillary desaturation has been measured in many laboratories. Morrow provides the most comprehensive desaturation data for both continuous and trapped oil [Chatzis, I. and Morrow, N.R., "Correlation of Capillary Number Relationships for Sandstone," SPEJ, Pg. 555-562, Oct. 1984]. Usually such experiments are conducted on horizontally oriented core samples and the effects of gravity are neglected. The capillary desaturation curve (CDC) graphically demonstrates the capillary number ($N_c$) required to reduce the residual saturation from high IFT values of 30-40% to values near zero at ultra-low IFT's. Well known values of $10^{-4}$ for initiation of desaturation to $10^{-2}$ for complete desaturation have been proposed by various authors.

The addition of gravitational forces is effective in reducing the residual saturation further. It has been shown previously that changing the orientation of a core from horizontal to vertical will greatly increase recovery in gas drive experiments [Foulser, R.W.S., Naylor, P. and Seale, C., "Relative Permeabilities for the Gravity Stable Tertiary Displacement of Oil by Nitrogen", 10th International IEA Symposium on Enhanced Oil Recovery, Oct. 4-6, 1989, Stanford, Calif.]. Morrow and Songkran [Morrow, N.R. and Songkran, B., "Effect of Viscous and Buoyancy Forces on Nonwetting Phase Trapping in Porous Media," *Surface Phenomena in Enhanced Oil Recovery*, D.O. Shah (ed.), Plenum Press, New York City, 387-411, 1982] investigated the relative effects of capillary number ($N_c = v\mu/\sigma$ and Bond number ($N_B = \Delta\rho g R^2/\sigma$) on desaturation where R is the particle radius of glass beads used to pack columns. By changing the bead size, the Bond number could be varied as the capillary number was kept constant. It should be noted that the Bond number is the inverse of $\pi_3$, the capillary to gravity ratio used by Du Prey. Morrow and Songkran found the residual saturation remained constant for inverse Bond numbers greater than 200. Decreases in the Bond number at a constant capillary number less than $3 \times 10^{-6}$ caused the residual saturation to decrease down to zero when the inverse Bond Number was about 3. The residual saturation was correlated with a linear combination of Bond and capillary numbers. In their experiments, air was displaced from the top of the column by injecting the wetting oil phase from the bottom.

The report to the Department of Energy entitled "Scale-Up of Miscible Flood Processes", 1991 by the present inventors was performed under Contract No. DE-FG21-89MC2653. In Section 3.4, experimental results were presented that indicated lowering the IFT between the imbibing brine phase and the oil phase did not necessarily reduce the rate of recovery, as had been previously predicted according to scaling theory and verified by the experiment of Cuiec. We attributed this disagreement between theory and Cuiec's experiments with our experiments to the increased importance of gravity.

Those experiments were performed to understand the mechanisms of displacement during a $CO_2$ flood in a horizontally bedded reservoir. Poor performance in such floods was attributed to thin high permeability streaks which allowed the injected $CO_2$ to rapidly breakthrough to the production well causing uneconomic recoveries. After breakthrough, oil which had been uncontacted by the solvent would flow transverse to the injection fluid from the surrounding low permeability layers. This process has been referred to as "crossflow". There are three kinds of crossflow: 1) viscous, in which the oil is "dragged" into the flow stream 2) capillary, in which oil is "sucked" into the flow stream and 3) gravity which causes the more dense oil to fall by the gravitational pull. We had observed and noted that this gravity effect was larger than expected because of the low interfacial tensions and therefore gravity will play an important role during crossflow.

We had made the observation that low IFT fluids can move rapidly, so we began to analyze crossflow in terms of microscopic pore scale events which would allow more rapid transport of oil from low permeability to high permeability layers. In this case, crossflow is an imbibition mechanism. That is, the crude oil prefers to adhere to the rock surface or "wet" the surface as opposed to $CO_2$. This in effect, causes the high perm zone which has been swept by the $CO_2$ to be saturated with a nonwetting phase. This would cause capillary action and the high perm zone sucks in the wetting phase, the same process by which water rises in a capillary tube. In the DOE report, there was no mention of the drainage process or had any drainage experiments been performed. We were not concerned with the drainage mechanism (by which nonwetting phase is forced into a zone where a wetting phase resides) and certainly not in vertically fractured reservoirs. In the cited DOE report, the microscopic Bond number was used to explain increased recoveries at low IFT. The Bond number or the ratio of the gravity force to the capillary force was originally calculated by $$N_B = \frac{R^2 g \Delta\rho}{\sigma}$$

In this case, $R^2$ is the radius of the pores. Obviously, as the pore radius increases, the effect of gravity becomes more important. This type of analysis does not reflect the height of the fracture block which would be incorrect in applying miscible floods to vertically fractured reservoirs.

There is still a need for a method of utilizing $CO_2$ gas in recovery petroleum from reservoirs containing extensive vertical fracture systems. Such a method and a method of screening reservoirs for use of $CO_2$ gas in vertical fractures are described herein.

SUMMARY OF THE INVENTION

The present invention provides a method of determining which of a plurality of vertically fractured formations is the optimum formation for use of $CO_2$ in a miscible or near miscible assisted recovery process. The ratio of vertical permeability to horizontal permeability ($K_v/K_h$) should be at least 1 and preferably should be much higher as is usually the case in fractured reservoirs. The value of the capillary to gravity ratio ($N_B^{-1}$) is determined where for each of a plurality of fractured formations $$N_B^{-1} = \sqrt{\frac{\phi}{k}} \; \frac{\sigma \cos\theta}{\Delta\rho g h}$$

where

K = reservoir permeability $\phi$ = reservoir porosity $\sigma$ = interfacial tension between $CO_2$ and crude oil $\Theta$ = contact angle (describes wettability)

$\Delta\rho$ = density difference between $CO_2$ and crude oil g = gravitational acceleration constant h = height of fractures;

The $N_B^{-1}$ value for each of the fractured formations is compared and the formation with the lowest $N_B^{-1}$ value is selected provided such value is less than about 0.2 as the optimum formation for the $CO_2$ miscible or near miscible recovery process. In a similar manner, a formation can be screened as a candidate for a $CO_2$ gas injection project.

Further the invention provides a method of assisting the recovery of petroleum from a vertically fractured petroleum containing reservoir of the Spraberry type by injecting $CO_2$ gas into the formation at a pressure approaching the miscibility pressure of said $CO_2$ and said petroleum to lower the interfacial tension between the $CO_2$ and the petroleum. The $CO_2$ is injected into the formation at a rate to insure that it enters and travels up the vertical fractures. Early rapid breakthrough to a producing well indicates that injection should be slowed to permit $CO_2$ to enter the vertical fractures. Thus the $CO_2$ flows into and up the vertical fractures and contacts petroleum in the formation adjacent the vertical fractures to dissolve $CO_2$ into the petroleum to lower the interfacial tension between the $CO_2$ and the petroleum to establish a gravity drainage of petroleum in the vertical fracture network in the formation. Petroleum from the gravity drainage zones of the formation is produced by suitable means such as a conventional production well or from a horizontal well or well system.

The method of the present invention is particularly adapted to the Spraberry field. Thus a method of recovering petroleum from vertically oriented fractures of a selected reservoir of the Spraberry formation is provided. $CO_2$ is injected into the lower portion of a selected reservoir of the Spraberry formation at a pressure approaching the miscibility pressure of $CO_2$ and the petroleum contained in the selected reservoir of the Spraberry formation. At least a portion of the injected $CO_2$ rises and saturates the vertical fractures thereby going into solution with the petroleum contained therein to lower the interfacial tension between the oil to the $CO_2$ to establish a gravity drainage zone of the oil in the vertical fractures. Gravity drainage oil is recovered from the formation by suitable means.

OBJECT OF THE INVENTION

It is a particular object of the present invention to provide a method of $CO_2$ gas injection to reduce the interfacial tension of petroleum in formations having extensive vertical fracture systems, including vertical fractures of height sufficient to provide a value for $N_B^{-1}$ of 0.2 or less, to initiate gravity drainage of the petroleum in such fracture system and to recover such drained oil from the formation. It is a further object of the present invention to provide a method of screening formations having extensive vertical fractures to select optimum candidates for a $CO_2$ miscible or near miscible floods where gravity drainage is the prime recovery mechanism.

Further objects and advantages of the invention will become apparent from the following detailed description read in view of the accompanying drawings which are made and incorporated herein as part of this specification.

DETAILED DESCRIPTION OF THE INVENTION

Figure 1:
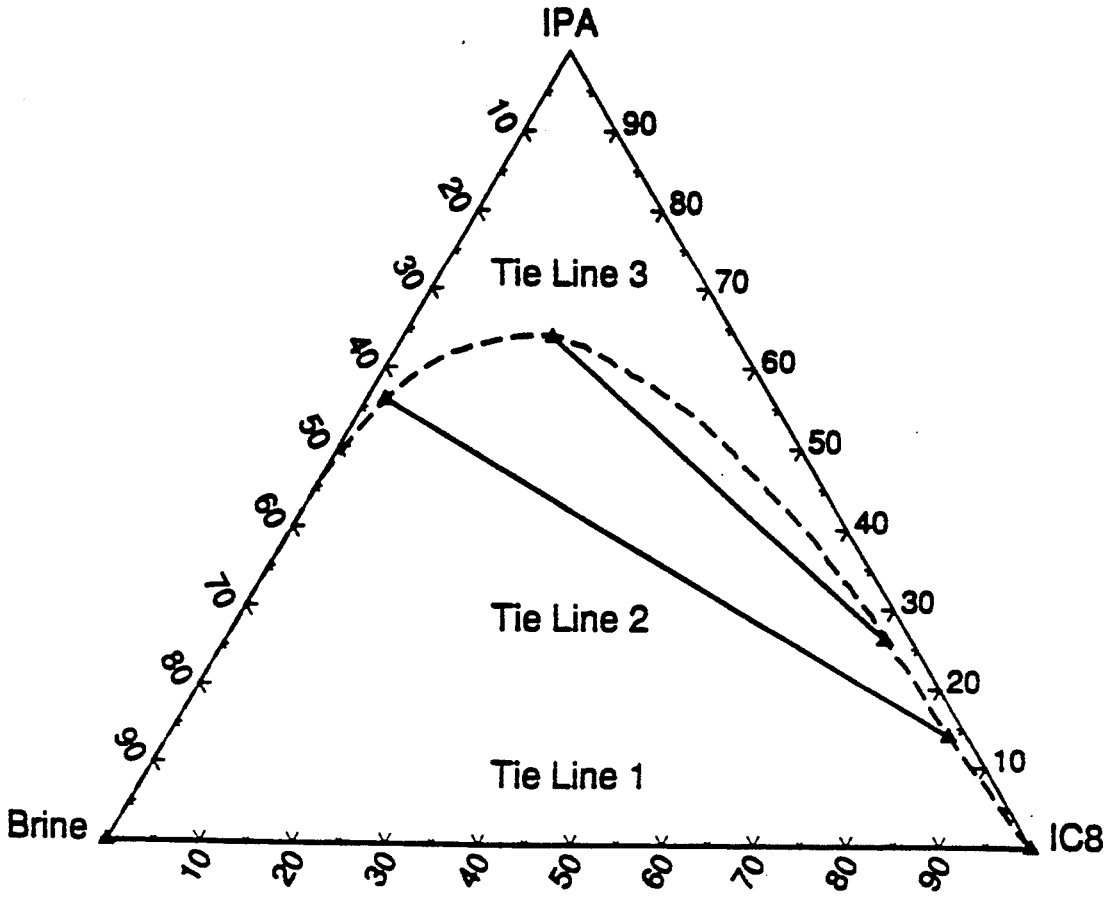
FIG. 1 is a phase diagram for ICS, IPA and brine system.

The present invention provides a method for determining which formations having extending vertical fracture system may be suited to assisted recovery using $CO_2$ injected at near miscible pressure. First, it is very important to examine criteria the fracture system existing in the formation. If there is a high fracture density in the formation and a lot of the fractures are vertically oriented it can be assumed that the ratio of vertical to horizontal permeability will be greater than 1. It is very desirable that the ratio of vertical fractures to horizontal fractures be high. It is also important that the height of the fracture be large. In this regard, the higher the fracture the better the gravitational drainage can achieved.

The phase behavior of the fluids is important. In other words, how extensively does the injected $CO_2$ mix with the crude oil which exists in the fractured reservoir? If the formation pressure is known and the minimum miscibility pressure of the $CO_2$ in the oil is known (in the laboratory we can measure the pressure at which $CO_2$ and oil become completely soluble) — the interfacial tension and the density difference between the $CO_2$ and oil phases can be calculated or measured. If the interfacial tension and the density difference of the $CO_2$ in oil are known the capillary entrapment forces can be determined.

The porosity and permeability of the matrix must be determined. A high permeability is obviously more favorable because high permeability means larger pore sizes which means there is less resistance to flow, i.e. the capillary forces are lower. Thus, the porosity and permeability are important to success of a $CO_2$ recovery project according to the invention.

As noted, the height of the fractures is very important. Since the capillary entrapment of the miscible flood is countered by the hydrostatic pressure that can be created in the fractures the fractures need to be high enough to release the oil. With formation microscanners or with logging methods, the height of the fractures should be determined. At this point with the information from above, the inverse Bond number or the capillary to gravity ratio can be determined. Knowing what the capillary to gravity ratio (which equals $1/N_B$) is, the second screening criteria can be made. That is, are we in the region in which flow is dominated by gravity forces. Therefore, if $CO_2$ is injected, gravity will allow the oil to be released readily from the matrix blocks of the formation.

A formation in which the invention of the present invention will be particularly useful is the Spraberry. The Spraberry formation in West Texas encompasses an area over four counties. There has been estimates of up to 10 billion barrels of oil in place yet less than 1 billion barrels of oil have been recovered. The recovery efficiency is on the order of 6 to 10%. Spraberry has been called one of the largest uneconomic reservoirs in the world and it has frustrated oil operators for decades now. It has been extensively waterflood since the 1950's and back then it had been proven that imbibition was an effective recovery mechanism with Spraberry cores. Simply taking Spraberry cores, putting them in water and watching imbibition occur led the original operators to waterflood the area and since then the area has been under waterflood and in most cases the wells have been watered out. There has been a lot of pressure maintenance by water injection which implies that even though this is a rather depleted reservoir by the imbibition mechanism, there is still good pressure for $CO_2$ miscible flooding.

Spraberry is a highly fractured reservoir and some of the fractures are known to go vertically up to 100 feet. Waterflooding in such a formation would have left the water slumping into the lower part of the formation thereby leaving a large portion of the oil uncontacted in the upper part of the formation. Since there is vertical communication due to the high vertical permeability created by the fractures when $CO_2$ is injected into the Spraberry formation that it will naturally rise and contact oil that has been uncontacted by water. The mechanism producing lower interfacial tensions by solubilizing the oil will allow the $CO_2$ to penetrate the upper portion of the matrix because of the high gravitational pressure associated with the $CO_2$ existing in those fractures.

There is extensive fracturing in the Spraberry formation. The fracture spacing seems to be reasonably close. Fractures range from 0.05 to 0.1 cm in thickness. Other sources describe some of the fractures as paper thin to ¼ in. thick. It's clear that the fractures are large and that they occur in trends. Fractures contribute very little to oil storage. The matrix rocks provides all of the critical porosity for oil storage. In fact the fractures contribute about 0.1% of the porosity that the matrix does. Although they do contribute to not very much porosity the fractures do provide a tremendous amount of permeability in the Spraberry. The fractures increase the permeability of the rock about 14 times. The matrix has a permeability of 0.5 millidarcis and an average porosity of 8%. This is an extremely low permeability but from our lab studies it has been found that if the fractured height is great enough, then the adverse effects of the capillary bound wetting phase is no longer greatly affected by the permeability. The hydrostatic pressure create in the fracture can still move the fluids.

Initial Spraberry pressures tend to be around 2000 to 2500 psi. At this pressure, there is very little gas, it's mostly oil. This is 400 or 500 psi above the saturation pressure. Since this is a live oil, 37 API gravity, we would expect a minimum miscibility pressure to be on the order of 2000 psi which implies that if we injected $CO_2$ above the pressure of the reservoir we would be near miscibility.

Drainage would seem to be inefficient in Spraberry since the permeabilities are so low. But in our lab studies relatively high permeability cores having only two feet of fracture length indicated favorable results. So with a fractured length of 2 feet and the moderately low IFTs created as would be the case when $CO_2$ is injected near its miscibility pressure then gravity drainage is very effective. In Spraberry the permeabilities will be extremely low yet the fractured heights are many times greater than what was done in the lab. So therefore, the pressure created inside of those fractures will be great enough to drive the non-wetting gas phase into the reservoir just as we are able to force the non-wetting phase into the porous medium in the laboratory in high permeability sandstones. The crucial issue is what the relative capillary to gravity forces are. We can calculate the capillary to gravity force in the lab and with a 2 foot fracture and low IFTs we found that we can get similar capillary to gravity ratios on a field level of much lower permeabilities if the fractures are on the order of 10's of feet.

The following examples indicate two reservoirs which would be suitable to be $CO_2$ flooding in accordance with the invention and one that would not.

EXAMPLE I

For the Spraberry Formation in West Texas:

| | | | | |
|---|---|---|---|---|
| k | = | average permeability | = | 0.5 md |
| h | = | height of fractures | = | 100 ft |
| $\phi$ | = | porosity = | = | 0.08 |
| Pressure of reservoir | | | = | 2000 psia |

At this pressure, interfacial tensions near 0.1 mN/m are achievable. This means the density difference ($\Delta\rho$) will be near 0.1 grams/cm$^3$.

| | | | | |
|---|---|---|---|---|
| $\sigma$ | = | interfacial tension | = | 0.1 mN/m |
| $\Delta\rho$ | = | 0.11 grams/cc | | |

$$N_B^{-1} = \sqrt{\frac{\phi}{k}} \quad \frac{\sigma}{\Delta\rho g h}$$

Inverse Bond Number = $N_B^{-1} = 0.043$

EXAMPLE II

For a Formation in Western Louisiana:

| | | | | |
|---|---|---|---|---|
| k | = | average permeability | = | 1 md |
| h | = | height of fractures | = | 160 ft |
| $\phi$ | = | porosity = | = | 0.3 |
| Pressure of reservoir | | | = | 750 psia |

At this pressure, interfacial tensions near 1.0 mN/m are achievable. This means the density difference ($\Delta\rho$) will be near 0.2 grams/cm$^3$.

| | | | | |
|---|---|---|---|---|
| $\sigma$ | = | interfacial tension | = | 1.0 mN/m |
| $\Delta\rho$ | = | 0.2 grams/cc | | |

Inverse Bond Number = $N_B^{-1}$ = 0.183

EXAMPLE III

For a Formation in Austin Chalk (Texas)

| | | | | |
|---|---|---|---|---|
| k | = | average permeability | = | .1 md |
| h | = | height of fractures | = | 12 ft |
| $\phi$ | = | porosity = | = | 0.33 |
| Pressure of reservoir | | | = | 1250 psia |

At this pressure, interfacial tensions near 2.0 mN/m are achievable. This means the density difference ($\Delta\rho$) will be near 0.22 grams/cm$^3$.

| | | | | |
|---|---|---|---|---|
| $\sigma$ | = | interfacial tension | = | 2.0 mN/m |
| $\Delta\rho$ | = | 0.22 grams/cc | | |

Inverse Bond Number = $N_B^{-1}$ = 14.67

Our lab studies showed that during imbibition experiments as the IFT was lowered the rate and the recovery was greater. This did not make sense initially since the density difference which is the density driving force and the interfacial tension which is the capillary driving force were both decreasing. How can you get faster recovery and more recovery when these two driving forces are decreasing? This was not initially understood. Now it is evident that there is a trade off between capillary and gravity flow and there is a transition from capillary dominated to gravity dominated flow which is characterized by faster rates and higher recoveries.

To optimize the benefits from the process of the invention you need to ensure that you don't get early breakthrough. To not get early breakthrough you have to inject at a slow enough rate for the gravity forces to work and allow the $CO_2$ to rise in the fractures thereby displacing the oil. Once these paths are created up into the fractured network, the $CO_2$ that is continued to be injected will also travel up that path, thereby displacing more oil. If the injection pressure is too great, then the $CO_2$ will be traveling more rapidly in the longitudinal direction toward the production wells, thereby missing the gravity flow region which allows it to rise and thereby not contacting as much as the reservoir as could be accomplished if the flow were strictly gravity dominated. Early breakthrough i.e. 1–2 days is an indication that injection pressure is too high and should be reduced.

Crosswell tomography may be used to map the path of $CO_2$ to ensure that $CO_2$ was for the most part flowing vertically and a gravity dominated process, as opposed to flowing longitudinally in the viscous dominated direction. Crosswell tomography may be used to verify the fact that gravity drainage is occurring. You need to do a Crosswell tomography baseline prior to $CO_2$ injection to establish where the oil saturations are. After the $CO_2$ injection proceeds you need to do another Crosswell tomography in order to see if the $CO_2$ is rising into the upper part of the zone in displacing the oil.

Experimental Procedure

Cylindrical cores about 60 cm in length and 6.35 cm in diameter were mounted vertically in a plexiglass holder. In a typical imbibition experiment, the core was saturated with oil, and then it was rapidly immersed in water. The less dense oil phase was then produced by a combination of gravity segregation and capillary imbibition. For drainage experiments, the core was saturated with the aqueous or wetting phase and rapidly immersed in the nonwetting phase.

To investigate how oil recovery changes with IFT, experiments were performed with the mixtures of isooctane ($IC_8$), brine (2 wt.% $CaCl_2$) and isopropanol (IPA). The imbibition experiments were performed with equilibrated fluids on three tie lines shown in FIG. 1. Properties of the phases are summarized in Table 1. As Table 1 and FIG. 1 show, as IPA is added, the IFT is reduced. On tie line 1 in FIG. 1, for example, the brine and IC8 with no IPA have an IFT of 38 mN/m and a density difference of 0.33 g/cm$^3$, while tie line 3 exhibits an IFT two orders of magnitude lower with a density difference that is three times lower.

TABLE 1

Phase Properties for Three Equilibrium Tie-Lines

| Tie Line | $\Delta\rho$ (g/cm$^3$) | IFT (mN/m) | Viscosity Ration ($\mu_\omega/\mu_o$) |
|---|---|---|---|
| 1 | 0.33 | 38.1 | 2.0 |
| 2 | 0.21 | 1.07 | 6.25 |
| 3 | 0.11 | 0.10 | 3.71 |

Figure 2:
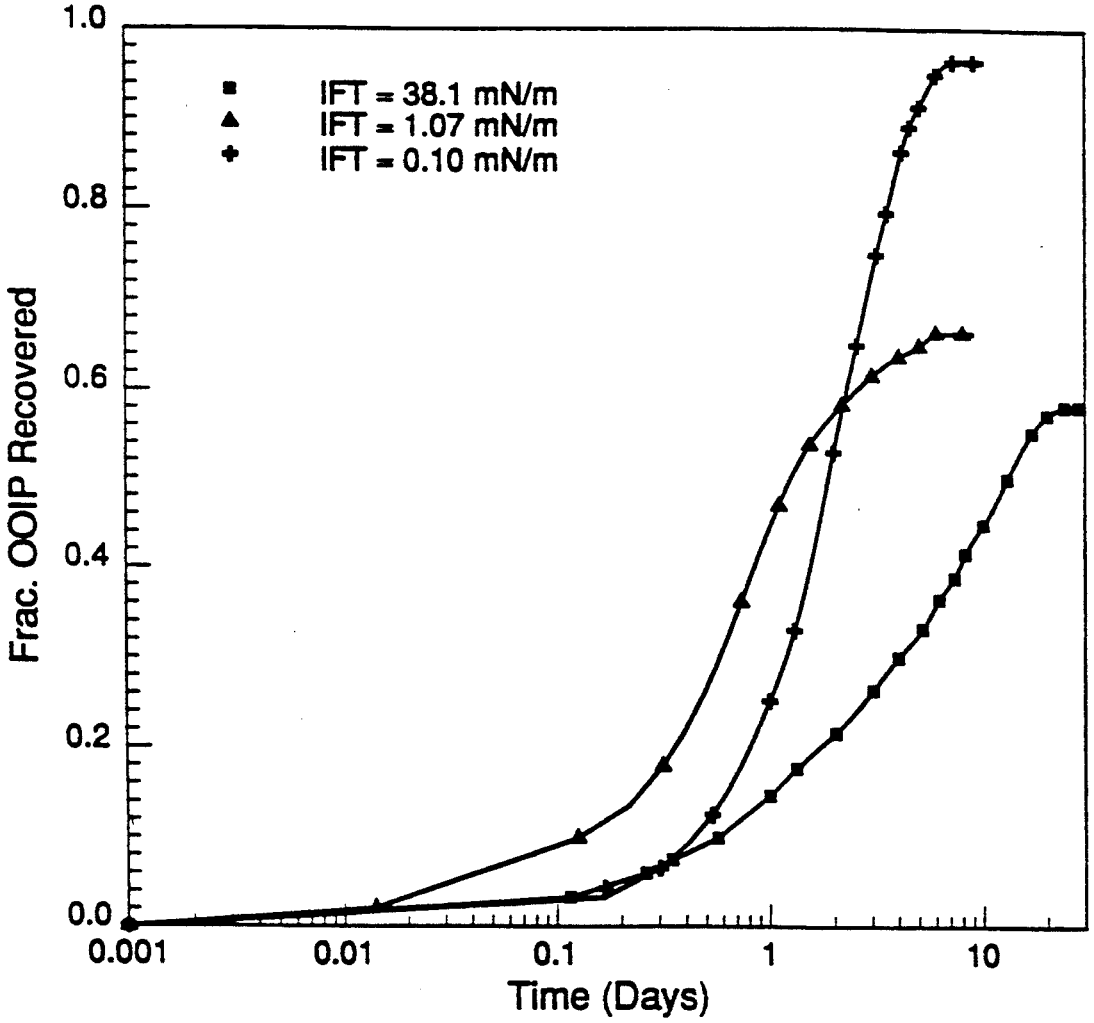
FIG. 2 is a recovery cure for 100 md Berea at the three different IFT's.

Results of imbibition experiments in a Berea sandstone core with a permeability of 100 md are shown in FIG. 2. Despite the fact that both the capillary and density driving forces decreased as the IFT was reduced, the total recovery and the rate both increased. From FIG. 2, it is seen that reducing the IFT between the imbibing brine phase and the oil phase will increase the ultimate recovery. Such behavior is akin to capillary desaturation. A similar plot to demonstrate gravity desaturation may be obtained by plotting the CGR vs. the remaining oil saturation at the end of an imbibition experiment for the various values of IFT. The value of capillary to gravity ratio was calculated according to the following equation:

$$CGR = N_B^{-1} = \frac{\sigma\sqrt{\frac{\phi}{\kappa}}}{\Delta\rho g h}$$

The values of GGR for each of the experiments in the four core samples may be found in Table 2.

TABLE 2

Capillary to Gravity Ratio for Imbibition Experiments

| K (md) | Tie-line 1 | Tie-line 2 | Tie-line 3 |
|---|---|---|---|
| 15 | 25.66 | 1.13 | 0.202 |
| 100 | 10.81 | 0.477 | 0.085 |
| 500 | 5.13 | 0.227 | 0.04 |
| 700 | 4.05 | 0.179 | 0.032 |

Figure 3:
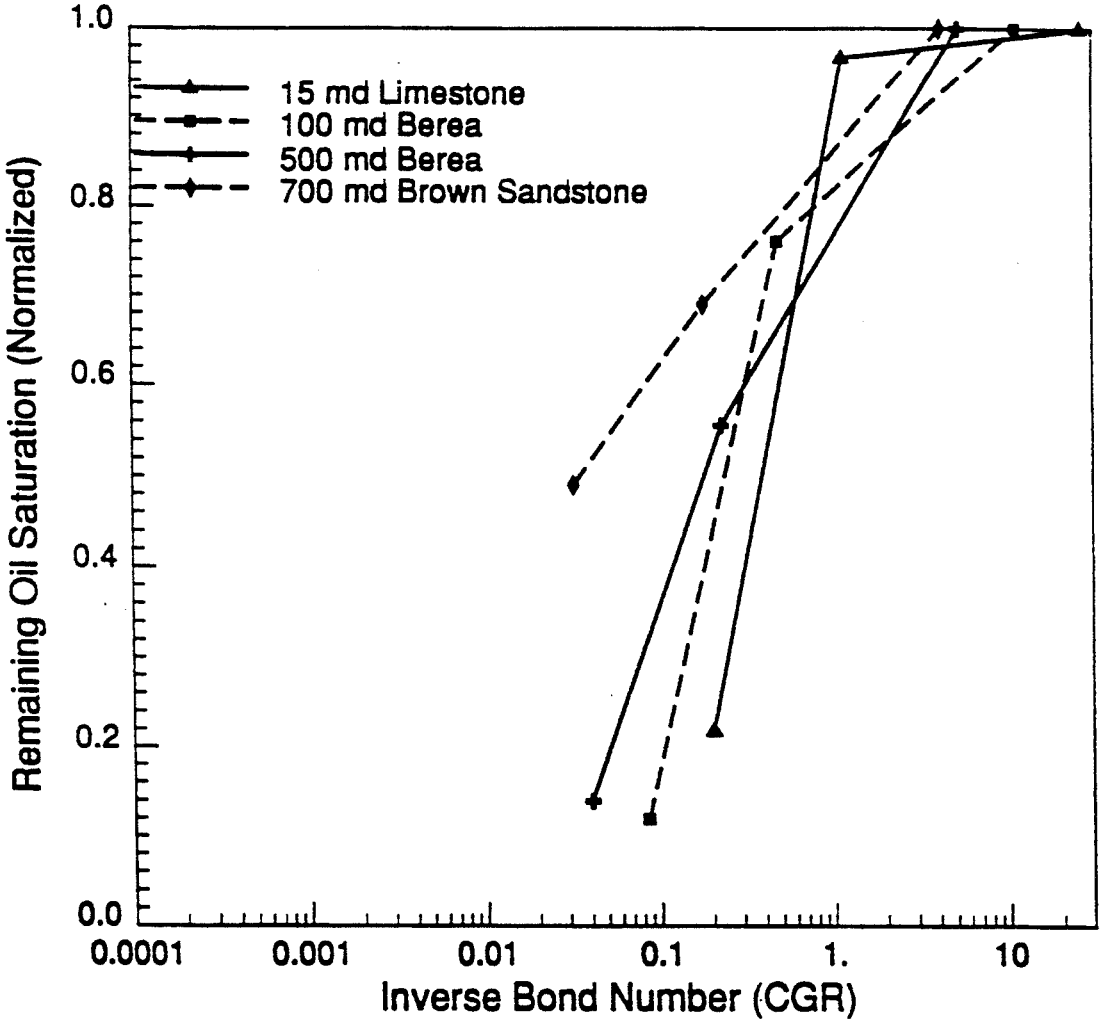
FIG. 3 is a diagram showing residual saturation vs. capillary to gravity ratio for imbibition experiments.

The final recovery varies from samples depending on the nature of the porous network. For instance, in the brown sandstone which is very heterogeneous, recoveries are much lower than for Berea which tends to be fairly homogeneous. As observed in FIG. 3, the residual saturation normalized to the saturation obtained at the end of high IFT imbibition reaches a threshold value of $N_B$ and any further decreases in the capillary to gravity ratio results in significant decreases in the residual saturation. In this respect gravity desaturation is completely analogous to capillary desaturation.

Figure 4:
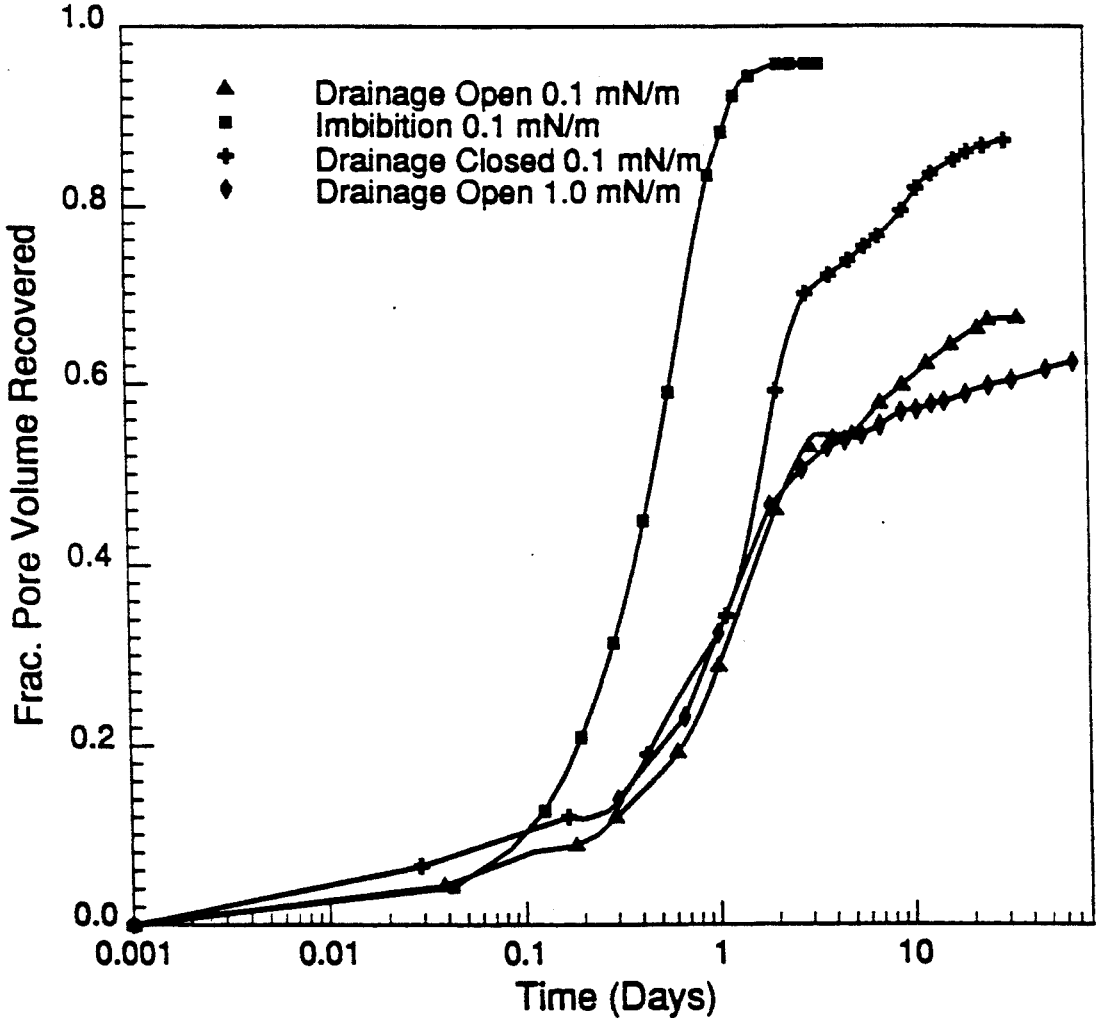
FIG. 4 is a diagram showing drawings of brine, IFT = 0.1 and 1.0 mN/m, from 500 md Berea.

The experimental results in FIG. 2 indicate that relatively rapid and high recovery is possible even when the IFT is only moderately low. As the IFT is reduced gravity forces become more important relative to the capillary forces. It is important to recognize that when capillary pressure is diminished, both the wetting and nonwetting phases segregate by gravity, which can lead to efficient production rates and high final recoveries. FIG. 4 shows, for example, that when the equilibrated fluids of tie line 3 were used, the wetting brine phase initially present in the core could be removed by gravity drainage just as the oil phase could by gravity imbibition. Presumably, the imbibition and drainage curve would be the same at neutral wetting conditions or negligible capillary pressure. Obviously, capillary pressure is important even at this low value of IFT as is evidenced by the longer time required for drainage.

Another interesting observation is seen in FIG. 4. A drainage experiment was performed in which the 500 md Berea core was saturated with wetting phase on tie line 2. Thus, the IFT between the two phases was an order of magnitude greater (1.0 mN/m) than the aforementioned low IFT drainage experiment. As opposed to the imbibition mechanism, it was observed that the recovery rate is independent of IFT during the initial stages of drainage. The recovery curves at different IFT's are superimposed until the breakpoint in which bulk flow is completed and film flow commences. Clearly, the slope of the film flow regime is different according to the value of IFT. The lower IFT drainage experiment is seen to drain more rapidly after the breakpoint is obtained. Apparently, increasing the IFT did not effect the rate of gravity drainage or the recovery until the breakpoint. This implies that ultra-low IFT's are not necessary in order to overcome the capillary threshold in cores of modest height and permeability.

Figure 5:
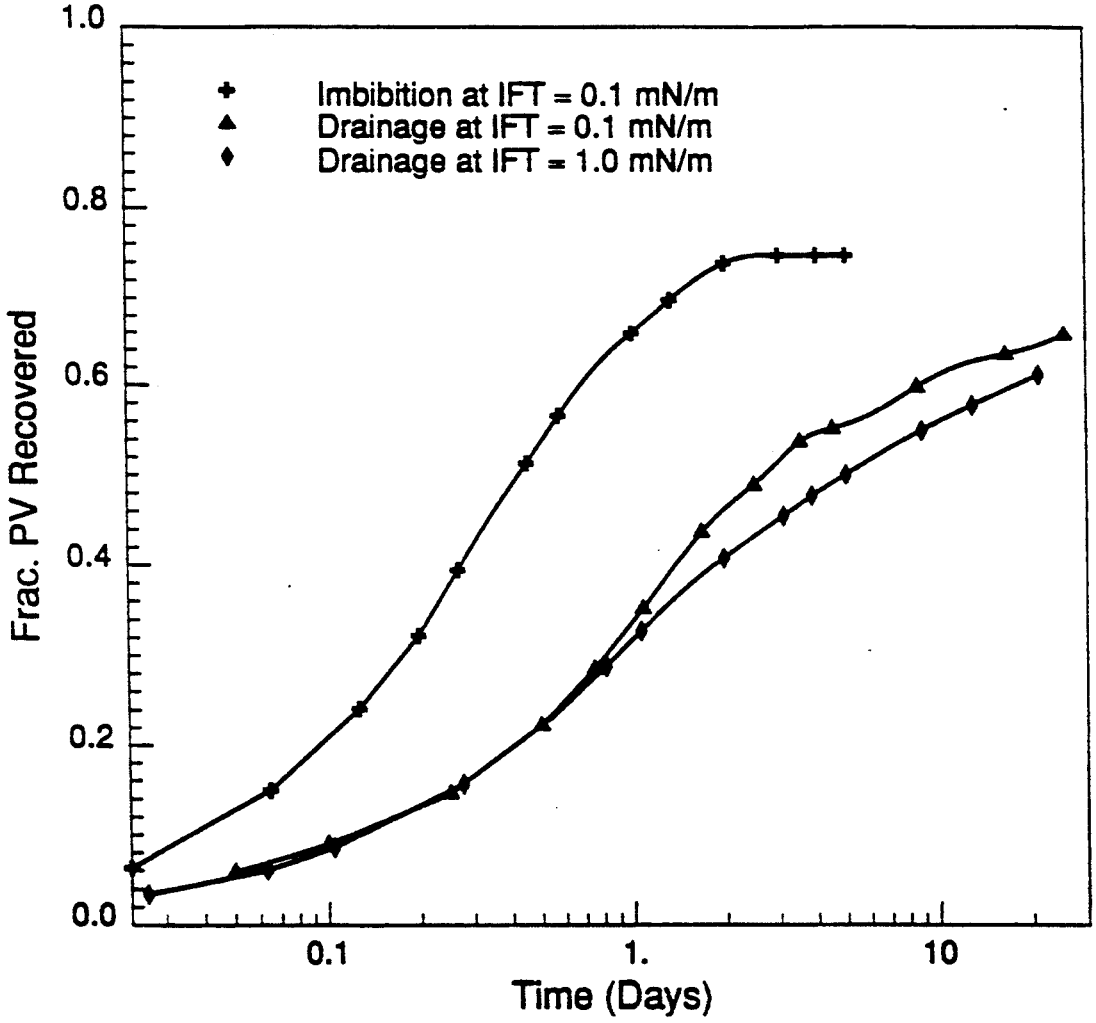
FIG. 5 is a diagram showing drainage recovery curves for 700 md Berea at two different IFT's compared to imbibition at 0.1 mN/m.

Similar data is plotted in FIG. 5. The result for imbibition at 0.1 mN/m is compared with drainage experiments at IFT's of 0.1 and 1.0 mN/m. As demonstrated previously, the larger pores empty at approximately the same rate for the two drainage experiments. In this case, the breakpoint denoting the onset of film drainage is not clearly defined as in the 500 md Berea core. This is not surprising due to the high degree of surface heterogeneities present on the 700 md brown sandstone core.

Figure 6:
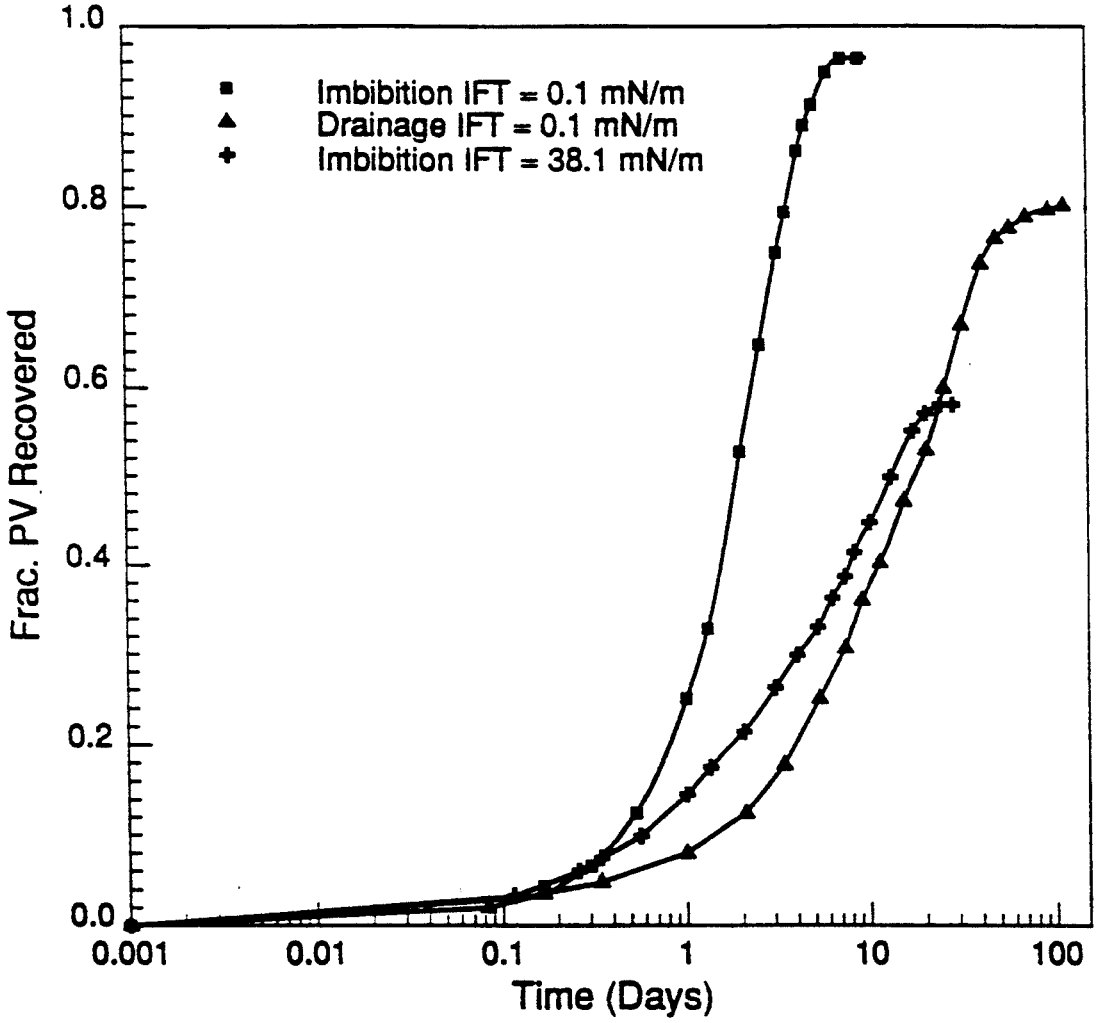
FIG. 6 is a diagram showing imbibition recovery curves for 100 md Berea at high and low IFT's compared to drainage at an IFT =0.1 mN/m.

FIG. 6 shows the imbibition data previously presented for the 100 md Berea core. Included in this plot is drainage data for the same fluids at an IFT 0.1 mN/m. Once again as in the case of the higher permeability Berea core, drainage occurs less rapidly than imbibition. But, the time scale for low IFT drainage is, interestingly, not very different from the high IFT recovery curve for imbibition yet the final recovery is much greater in the drainage experiment.

Thus, if IFT is moderately low, gravity forces can move substantial quantities of both wetting and nonwetting phases at significant rates. In multi-contact miscible flood processes, the effects of equilibrium partitioning of components between phases can easily produce IFT's in the range where enhanced gravity-driven crossflow is possible. Results of imbibition and drainage experiments conducted at low IFT in long cores with a wide range of permeabilities are contained in our SPE Paper 22594.

Figure 7:
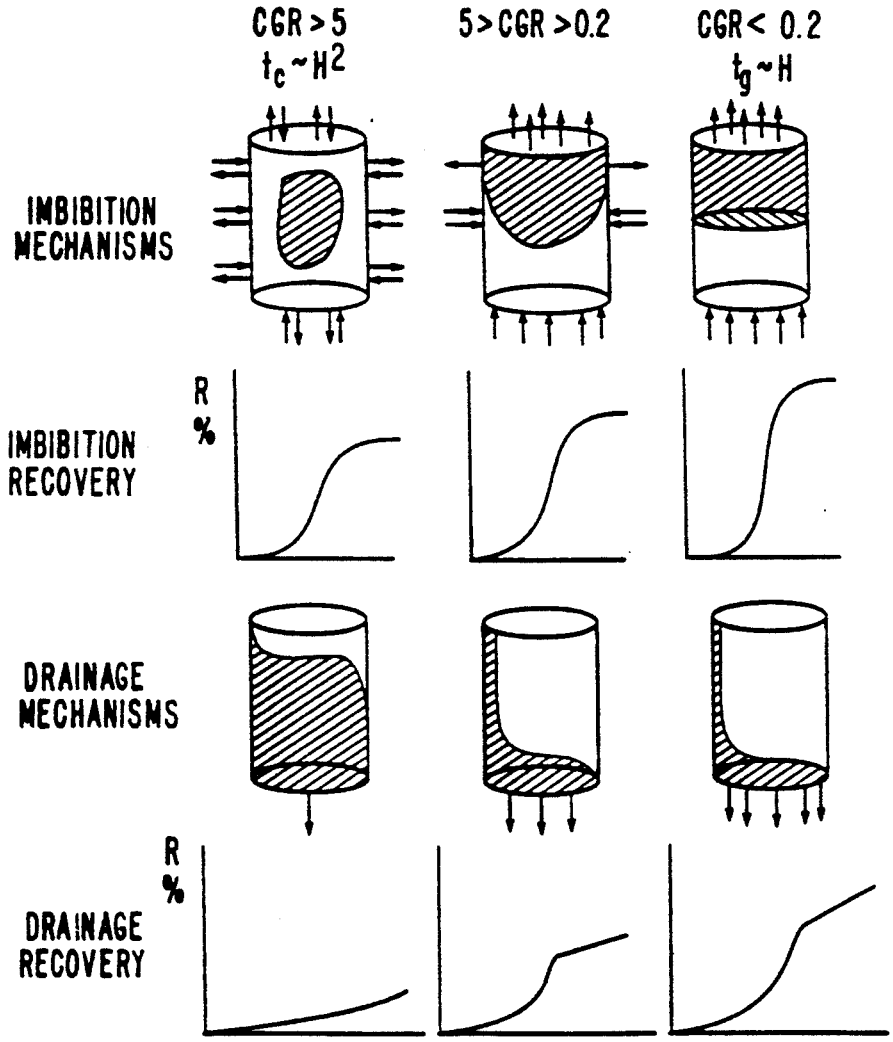
FIG. 7 is a schematic illustration of flow behavior for imbibition and drainage experiments at different value of CGR or inverse Bond number.

A summary of the mechanisms and the resulting recovery curves are shown in FIG. 7. As the permeability and fracture length increase, and the IFT decreases, the transition from capillary driven, countercurrent imbibition to gravity driven cocurrent segregation is demonstrated. The transition region has been defined as the CGR ($1/N_B$) varies from the capillary dominated region of around 5 to the gravity dominated region around 0.2. The time scales and recovery curves giving the general shape and final recovery is also shown.

Figure 9:
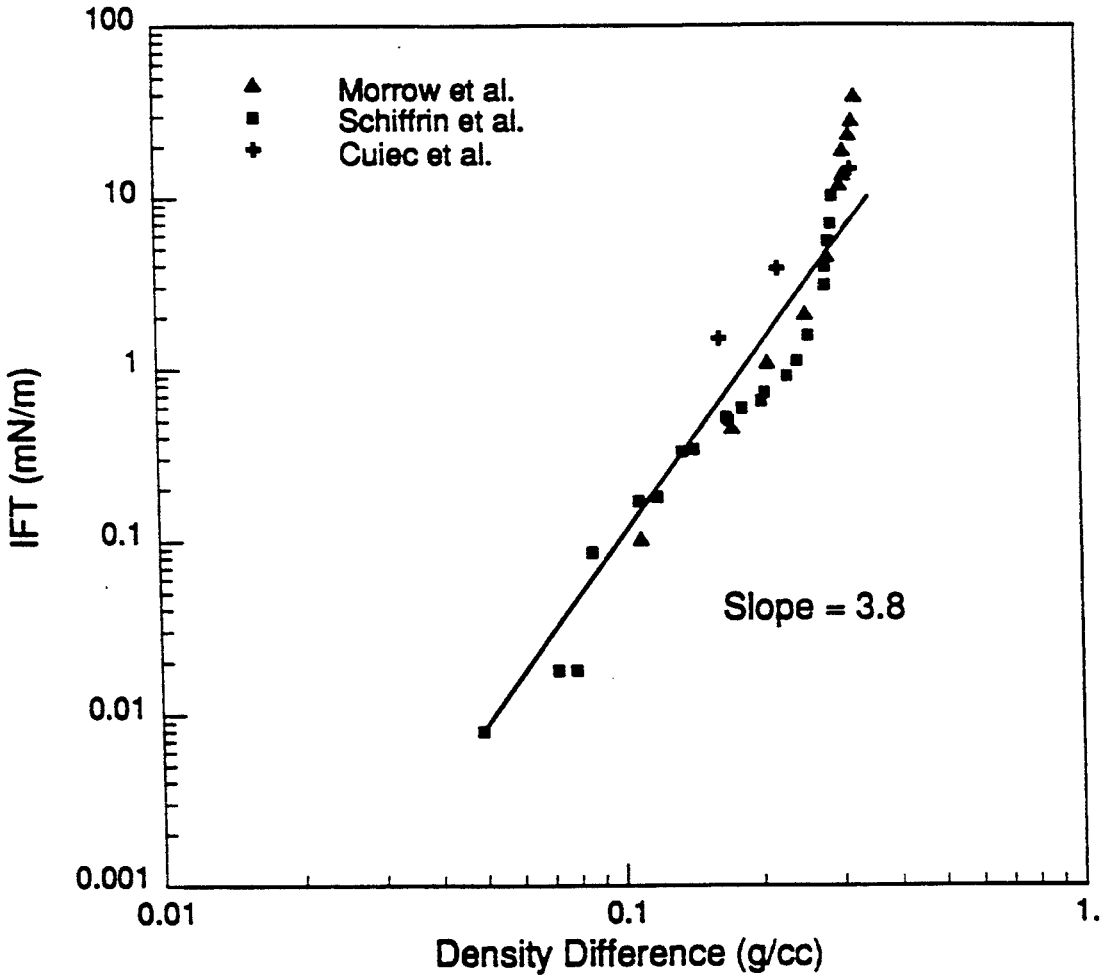
FIG. 9 is a diagram showing IFT as density difference for phases approaching miscibility.

Even though the experiments outlined were performed with analog fluids, they indicate that similar behavior will be quite important in MCM displacement processes in heterogeneous reservoirs. The explanation of this phenomenon comes from the fundamental principles of near critical phase transitions. An analysis of the scaling behavior of the density difference and IFT of coexisting phases near their critical point of miscibility indicates that as the critical point is approached, IFT decreases more rapidly than density difference. FIG. 9 shows a plot of IFT against density difference between phases for oil-water-alcohol systems [Cuiec, L.E., Bourbiaux, B. and Kalaydjian, F.; "Imbibition in Low-Permeability Porous Media: Understanding and Improvement of Oil Recovery," paper SPE 20259 presented at 1990 7th Annual Symposium on Enhanced Oil Recovery, Tulsa, OK, April; Morrow, N.R., Chatzis, I. and Taber, J.J.: "Entrapment and Mobilization of Residual Oil in Bead Packs", *Soc. Pet. Eng. Res. Eng.*, 3, 927–935, 1988; Satherly, J. Schiffrin, D.J.: "The Measurement of Low IFT Values for Enhanced Oil Recovery", Progress Report to U.K. DOE, Winfrith, August, 1985]. It demonstrates the relationship between density difference and IFT in the near-critical region and also shows the slope of the straight line of 3.8, which is consistent with critical scaling theory [Shang-keng, M.: *Modern Theory of Critical Phenonena,* Benjamin Cummings, Reading, Mass. (1976)].

According to that theory, the same behavior will be observed for gas-oil systems near a critical point. This was verified in measurements by Haniff and Pearce [Haniff, M.S. and Pearce, A.J.: "Measuring Interfacial Tensions in a Gas-Condensate System with a Laser-Light-Scattering Technique," *SPERE,* Pg. 589, Nov. 1988] on a gas-condensate mixture near miscibility. The phase equilibrium mechanism of a successful MCM process will generate mixtures that are near a critical point, and hence, there will be regions of the flow where gravity forces will be more important than capillary forces. In these regions, then, gravity-driven crossflow can be used to invade zones not swept by longitudinal flow if adequate vertical communication exists. This argument suggests that a miscible gas injection process could be used effectively in a fractured reservoir.

The results of these experiments suggest interesting possibilities for miscible or near-miscible gas injection into highly fractured reservoirs, a technique never considered due to the implicit belief of immediate breakthrough of the highly mobile injected gas. Near miscible conditions in a highly fractured network will cause efficient gravity drainage resulting in transfer of the nonwetting phase into the matrix block.

In fact, a successful field application of $CO_2$ injection in a fractured reservoir was recently reported [Beliveau, D. and Payne, D.A.: "Analysis of a Tertiary $CO_2$ Flood Pilot in a Naturally Fractured Reservoir," paper SPE 22947 presented at the 1991 Annual Technical Conference, Dallas, Tex., Oct. 6–9]. The observations reported by Beliveau and Payne are consistent with the mechanisms described here. They described a pilot test currently underway in the Midale field in which $CO_2$ was injected at a pressure above the MMP in a fractured carbonate reservoir. Before injection of $CO_2$ was initiated, water with tracers was injected in the pilot area. The tracers rapidly broke through to the producing wells, in some cases, in less than one day indicating complete communication between the injecting and producing wells and the fracture network. When $CO_2$ was injected, however, it broke through much later, a clear indication that $CO_2$ was invading low permeability matrix blocks. Actual oil production in the pilot test indicated that $CO_2$ utilization was only about 3 MCF/STB. At reservoir conditions 1.7 MCF were required to produce a barrel of oil, so the observed $CO_2$ utilization is remarkable. It is much lower than is typical in other miscible flood applications.

As noted spontaneous imbibition of injected water from the fractures into the porous matrix has long been considered an important oil recovery mechanism. It was heretofore considered unprofitable to reduce the surface tension of the water during imbibition since capillary pressure is the driving force behind imbibition and reducing the IFT would reduce the capillary pressure. As a consequence, there is very little known concerning alteration of the IFT for an imbibing fluid. Furthermore, laboratory studies of imbibition purposefully kept the core size small so as to keep gravity effects negligible. These two factors mistakenly ignored the fundamental behavior of immiscible phases near to the point at which they become miscible. According to the theory of critical scaling, the density difference between phases approaching miscibility will diminish less rapidly than the IFT. Thus, as miscibility is approached, even though the capillary forces are negligible, there is still a distinct density contrast between the phases. This essentially means that phase separation will occur as if in the absence of a porous medium, that is, the more dense fluid will move downward, thus displacing the less dense fluid.

When a matrix block is saturated with a more dense oil (wetting phase) and immersed in a less dense nonwetting phase, two forces will determine whether the wetting fluid will drain: 1) capillary forces which hold the wetting phase in place and 2) gravity forces causing the more dense phase to flow downward. Therefore, a balance between capillary and gravity forces, known as the Bond Number, will determine the efficiency of gravity drainage.

The Bond number i.e.

$$N_B = \sqrt{\frac{k}{\phi}}\ \frac{\Delta\rho g h}{\sigma\cos\theta}$$

k = permeability, $\phi$ = porosity, $\rho$ = IFT, $\theta$ = contact angle, $\Delta\rho$ = density difference between the phases, g = gravitational constant and h = height at which the gravity potential operates. We have found in our lab that at moderate values of IFT (0.1 mN/m as) would be the case in a $CO_2$/crude oil system near the miscibility pressure combined with the hydrostatic pressure created by surrounding and oil saturated block of moderate height with $CO_2$, will give Bond Numbers capable of inducing effective gravity drainage. In this specification, we have used the reciprocal of the Bond number i.e. $1/N_B$ which equals the CGR ratio for convenience.

Conventional rules of thumb have indicated miscible gas injection into a fractured reservoir would not be wise for the simple reason that the low viscosity of the $CO_2$ injected into the highly permeable fracture paths would lead to rapid breakthrough at the producing wells. However, if the fractures are vertically oriented as is the case in many fractured reservoirs and if $CO_2$ is injected into the bottom of the formation at a rate to discourage rapid breakthrough to a producing well, it will rapidly rise and saturate the fracture space. At the contact between the nonwetting $CO_2$ phase in the fraction and the wetting oil phase in the porous matrix, low IFT's will be created as the $CO_2$ and oil begin to mix. They I5 hydrostatic pressure due to the density difference between the two phases acting through the height of the fracture will overcome the capillary restraining forces thereby initiating rapid gravity drainage. Lab results indicate that this technique holds considerable promise in fractured reservoirs. For instance, prolific fields like the Spraberry trend in West Texas have historically produced only 6–10% of the calculated 10 billion barrels of reserves. The potential for $CO_2$ injection in this field alone is tremendous and there are many other such fractured fields.

The objective of a recovery method for fractured reservoirs should be to use the fracture network as a delivery system to carry injected fluid to the matrix regions to be swept and to move oil recovered from the matrix to production wells by gravity drainage. If a MCM gas is injected into a vertically fractured network, the gas will rise through the highly permeable fracture paths. The combination of the hydrostatic pressure and reduced IFT's as the gas becomes miscible with the oil in the matrix will allow gravity drainage to become an extremely effective recovery mechanism.

Figure 8:
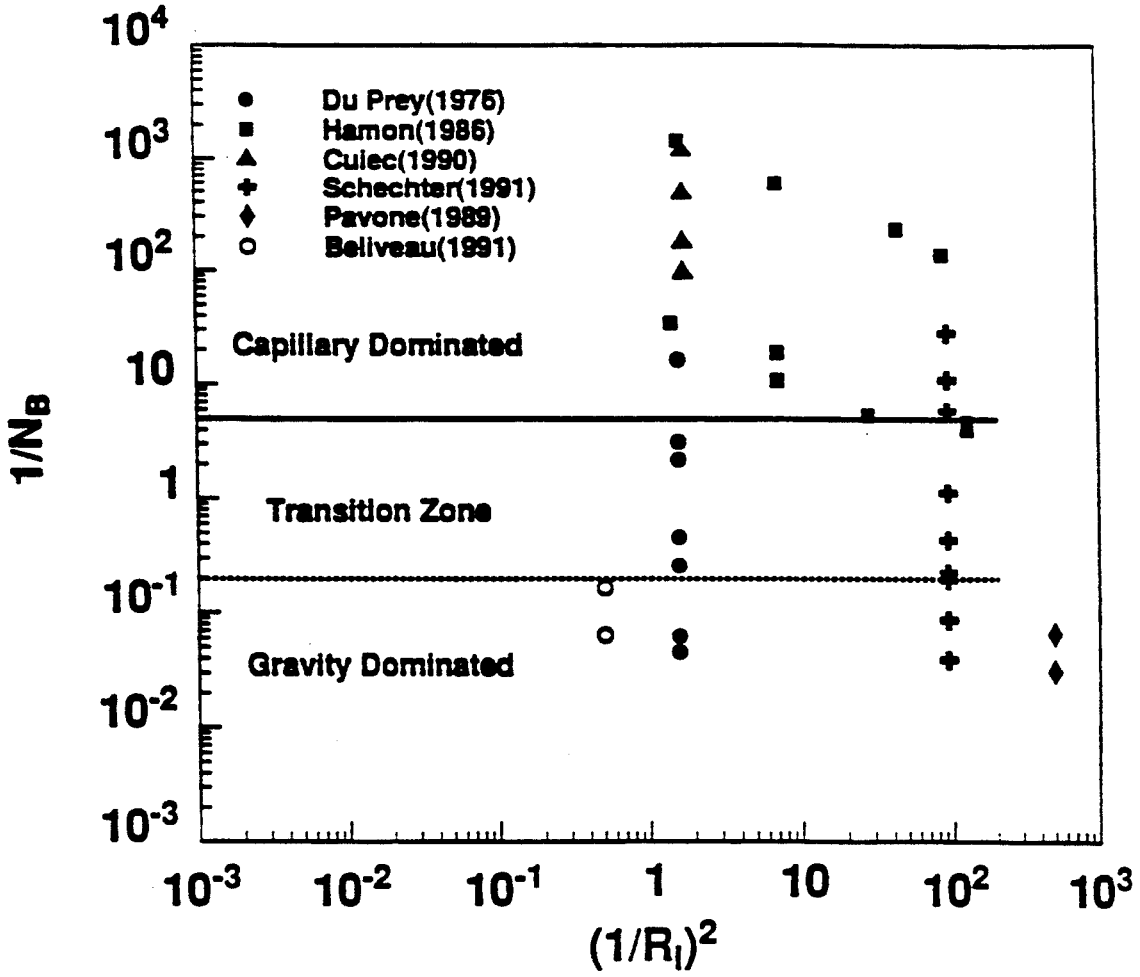
FIG. 8 is a diagram showing various processes plotted in the Capillary Dominated Zone, the Transition Zone and the Gravity Dominated Zone.
Figure 10:
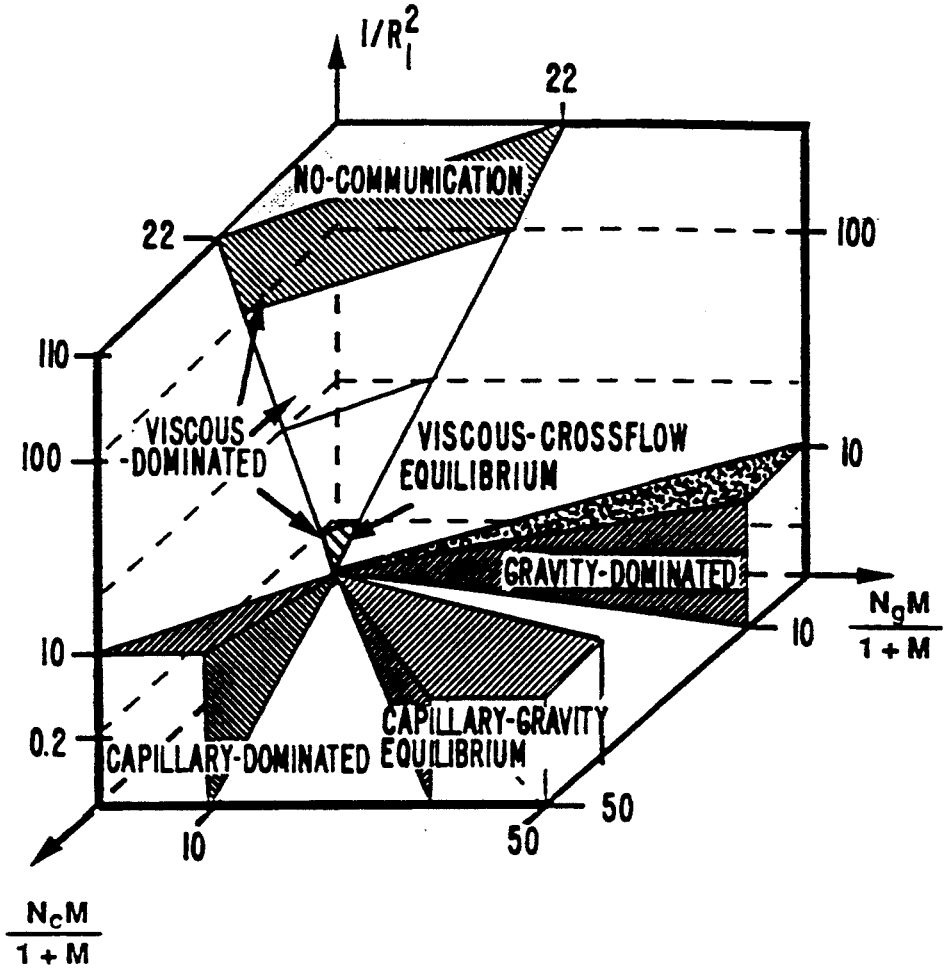
FIG. 10 is a perspective diagram showing flow regions of two-phase flow in heterogeneous porous media.

Referring now to FIGS. 8 and 10 where plots of the capillary to gravity ratio ($1/N_B$) and the shape factor $(1/R_1)^2$ are shown. If we know what the capillary to gravity ratio is, now we can make the second screening criteria. If we inject $CO_2$ into the vertically fractured reservoir (at the correct $1/N_B$, i.e. less than about 0.2), gravity will allow the oil to be released readily from the matrix blocks. Once we know that we are in the gravity region the next step is to calculate the shape factor of the formation which will allow us eventually to come to terms with what injection rate we should use.

$$\text{The shape factor} = \sqrt{\frac{K_v}{K_h}}\ \frac{L}{H}$$

If we are in the gravity dominated region, yet we inject the $CO_2$ too rapidly, it can pull us out of the gravity dominated region into the viscous dominated region. As shown in FIG. 10, if $N_gM/1+M$ (gravity number which is equal to the ratio of the gravity to viscous forces) is small enough, viscous forces will dominate over gravity forces. In FIG. 10, the capillary number shown on the Z axis should be negligible and the process should be maintained as far into the gravity dominated region as possible. Thus, $CO_2$ injection rates should be small enough to prevent early breakthrough, the viscous contribution should be small, and there should be adequate vertical communication. This means that the injection rate must be adjusted to optimize oil production but slow enough to keep us in the gravity dominated region. Monitoring the arrival of $CO_2$ at the production well and determining how long it takes to travel from the injection well will confirm there is gravity dominated flow. For example, the porosity of the fractures in the Spraberry reservoir accounts for 0.1% of the total porosity of the reservoir and if $CO_2$ is not saturating the matrix and is flowing longitudinally in the viscous region breakthrough will occur the time it takes for the $CO_2$ to pass through the fractures to the production well. So we have to know what the viscous contribution is relative to the shape factor, the capillary contribution and the gravity contribution. Knowing these parameters will permit defining a flow rate which will maintain the process in the gravity region.

We have determined that there is enough vertical permeability in Spraberry for a $CO_2$ gas injection to cause gravity drainage. We have the phase behavior of the fluids and the characteristics of the matrix and the height of the fractures to calculate a Bond number. With the Bond number now we know if we're in the gravity dominated region. We can calculate a shape factor based on the well spacing, the thickness of the pay, and vertical and horizontal permeabilities. After we know what the shape factor is we can use FIG. 10 to determine what injection rate will keep us in the gravity dominated region.

FIG. 10 is a three dimensional graph with the Y axis being $1/R_1^2$, the same parameter as in FIG. 8, which is the shape factor, but this time on the X axis we have the gravity number which is the ratio of gravity to viscous forces, not gravity to capillary forces. On the Z axis we have the capillary number which is the ratio of capillary forces to viscous forces. M represents the mobility ratio between the injected $CO_2$ and the oil in the reservoir. If we are in the gravity dominated region but the injection rate is too high then the viscous forces that occur as a result can actually pull the process away from the gravity drainage region. In other words, we are pushing the $CO_2$ in so fast now that the viscous forces dominate over the gravity forces. So in effect FIG. 10 gives us a way to design a flow rate at which we should inject in order not to leave the gravity dominated region.

The principles, preferred embodiments and modes of operation of the present invention have been described in the foregoing specification. However, the invention which is intended to be protected is not to be construed as limited to the particular embodiments disclosed. The embodiments are to be regarded as illustrative rather than restrictive . Variations and changes may be made by others without departing from the spirit of the present invention. Accordingly, all such variations and changes, which fall within the spirit and scope of the present invention as defined in the following claims, are expressly intended to be embraced thereby.

What is claimed is:

1. A method of assisting the recovery of petroleum from a vertically fractured petroleum containing reservoir of the Spraberry type wherein the value of the inverse Bond number is less than 0.2 comprising injecting $CO_2$ gas into said formation at a pressure approaching the miscibility pressure of said $CO_2$ and said petroleum in order to lower the interfacial tension between the $CO_2$ and the petroleum; continuing to inject the $CO_2$ into and up the vertical fractures in said formation, contacting petroleum in said formation adjacent said vertical fractures to dissolve $CO_2$ into said petroleum in order to lower the interfacial tension between the $CO_2$ and the petroleum to establish a gravity drainage zone of petroleum in said vertical fractures in said formation and recovering petroleum from said gravity drainage zones of said formation.

2. A method of recovering petroleum from vertically oriented fractures of a selected reservoir of Spraberry formation wherein $CO_2$ is injected into the lower portion of a selected reservoir of the Spraberry formation at a pressure approaching the miscibility pressure of $CO_2$ and the petroleum contained in said selected reservoir of the Spraberry formation wherein at least a portion of the injected $CO_2$ rises and saturates the vertical fractures thereby going into solution with the petroleum contained therein to lower the interfacial tension between the oil and the $CO_2$ and establish a gravity drainage zone of said oil in said vertical fractures wherein the capillary to gravity ratio ($1/N_B$) is less than about 0.2, comprising determining the shape factor $$\frac{1}{R_1^2} = \left(\sqrt{\frac{K_v}{K_h}}\ \frac{L}{H}\right)$$

where:

$K_v$ is the vertical permeability $K_h$ is the horizontal permeability

L is t he length

H is the height of the selected reservoir of said formation, injecting $CO_2$ into the selected reservoir of said formation at a rate in accordance with said shape factor $$\frac{1}{R_1^2} = \left(\sqrt{\frac{K_v}{K_h}}\ \frac{L}{H}\right)$$

to establish a gravity drainage zone and recovering oil from the gravity drainage zone of the selected reservoir of said formation.

3. The method of claim 2 further characterized in that the portion of the formation in which $CO_2$ is to be injected is logged prior to injection of $CO_2$ to establish oil saturations in said portion.

4. The method of claim 3 further characterized in that said portion of the formation is logged after $CO_2$ has been injected into said portion to determine if the oil is flowing vertically in gravity dominated flow.

5. The method of claim 4 further characterized in that said logging is done by a crosswell method.

6. A method of recovering petroleum from vertically oriented fractures of a selected reservoir of the Spraberry type penetrated by an injection well and a production well comprising the steps of determining the shape factor, $$\frac{1}{R_1^2} = \left(\sqrt{\frac{K_v}{K_h}}\ \frac{L}{H}\right)$$

where $K_v$ is the vertical permeability, $K_h$ is the horizontal permeability, H is the height and L is the distance between the injection and production wells of the selected reservoir; injecting $CO_2$ into the lower portion of the selected reservoir at a rate based on the shape factor and at a pressure approaching the miscibility pressure of $CO_2$ and the petroleum contained in said selected reservoir wherein at least a portion of the injected $CO_2$ rises and saturates the vertical fractures thereby going into solution with the petroleum contained therein to lower the interfacial tension between the oil and the $CO_2$ and establish a gravity drainage zone of said oil in said vertical fractures wherein the inverse Bond number is less than approximately 0.2 and recovering oil from the selected reservoir.

7. A method of assisting the recovery of petroleum form a vertically fractured petroleum containing reservoir of the Spraberry type wherein the value of the inverse Bond number is less than 0.2 comprising injecting $CO_2$ into said formation at a pressure approaching the miscibility pressure of the said $CO_2$ and said petroleum; allowing the $CO_2$ to rise in the vertical fractures in said formation and contact petroleum in said formation adjacent said vertical fractures to dissolve $CO_2$ into said petroleum in order to lower the interfacial tension between the $CO_2$ and the petroleum to establish a gravity drainage zone of petroleum in said vertical fractures in said formation and recovering petroleum from said gravity drainage zones of said formation.

* * * * *